US008674298B2

(12) United States Patent
Nakajima et al.

(10) Patent No.: US 8,674,298 B2
(45) Date of Patent: Mar. 18, 2014

(54) QUADRUPOLE MASS SPECTROMETER

(75) Inventors: Toyoaki Nakajima, Kanagawa (JP); Yuujirou Kurokawa, Kanagawa (JP); Tsutomu Yuri, Kanagawa (JP); Ryota Tanaka, Kanagawa (JP)

(73) Assignee: Ulvac, Inc., Kanagawa (JP)

( * ) Notice: Subject to any disclaimer, the term of this patent is extended or adjusted under 35 U.S.C. 154(b) by 12 days.

(21) Appl. No.: 13/519,928

(22) PCT Filed: Feb. 15, 2011

(86) PCT No.: PCT/JP2011/000834
§ 371 (c)(1),
(2), (4) Date: Jun. 29, 2012

(87) PCT Pub. No.: WO2011/102117
PCT Pub. Date: Aug. 25, 2011

(65) Prior Publication Data

US 2012/0280122 A1 Nov. 8, 2012

(30) Foreign Application Priority Data

Feb. 17, 2010 (JP) ..... 2010-032100

(51) Int. Cl.
*H01J 49/26* (2006.01)

(52) U.S. Cl.
USPC ..... 250/288; 250/281; 250/282; 250/289

(58) Field of Classification Search
USPC ..... 250/281, 282, 283, 286, 287, 288, 289
See application file for complete search history.

(56) References Cited

U.S. PATENT DOCUMENTS

| | | | | |
|---|---|---|---|---|
| 5,834,770 | A | 11/1998 | Holkeboer et al. | |
| 2002/0153820 | A1 | 10/2002 | Ellefson et al. | |
| 2005/0017166 | A1 | 1/2005 | Scheidemann et al. | |
| 2006/0226355 | A1 | 10/2006 | Watanabe et al. | |
| 2009/0096460 | A1 | 4/2009 | Watanabe et al. | |
| 2010/0084549 | A1 * | 4/2010 | Ermakov et al. | 250/283 |
| 2010/0213363 | A1 * | 8/2010 | Nakajima et al. | 250/281 |

FOREIGN PATENT DOCUMENTS

| | | | |
|---|---|---|---|
| JP | 62-150645 | A | 7/1987 |
| JP | 07-272671 | A | 10/1995 |

(Continued)

OTHER PUBLICATIONS

International Search Report for PCT Patent App. No. PCT/JP2011/000834 (May 24, 2011).

*Primary Examiner* — Robert Kim
*Assistant Examiner* — Hanway Chang
(74) *Attorney, Agent, or Firm* — Cermak Nakajima LLP; Tomoko Nakajima

(57) ABSTRACT

A quadrupole mass spectrometer for use in analyzing gas components in a test piece is made in a constitution in which resistance heating of a grid is materialized, and in which a high-accuracy analysis of the gas components is possible at a low cost while preventing the sensitivity from lowering. A quadrupole mass spectrometer is provided with a sensor section which can be detachably fitted to the test piece. Supposing that the direction of fitting the sensor section to the test piece is in an upward direction, the sensor section is provided with: a predetermined shape of supporting body which is provided at a lower end of the sensor section; an ion source which is provided on the supporting body and which has a filament and a grid for ionizing the gas; a quadrupole section which is provided on the ion source and in which four columnar electrodes are disposed at a predetermined circumferential distance from one another; and an ion detection section which is disposed on the quadrupole section and which collects predetermined ions that have passed through the quadrupole section by applying DC and AC voltages between opposite electrodes.

15 Claims, 5 Drawing Sheets

(56) References Cited

FOREIGN PATENT DOCUMENTS

| | | | |
|---|---|---|---|
| JP | 11-040099 | A | 2/1999 |
| JP | 2004-349102 | A | 12/2004 |
| JP | 2005-533338 | A | 11/2005 |
| JP | 2006-266854 | A | 10/2006 |
| JP | 2007-521616 | A | 8/2007 |
| WO | WO2006/121173 | A1 | 11/2006 |

* cited by examiner

QUADRUPOLE MASS SPECTROMETER

This application is a national phase entry under 35 U.S.C. §371 of PCT Patent Application No. PCT/JP2011/000834, filed on Feb. 15, 2011, which claims priority under 35U.S.C. § 119 to Japanese Patent Application No. 2010-032100, filed on Feb. 17, 2010, both of which are incorporated by reference.

TECHNICAL FIELD

The present invention relates to a quadrupole mass spectrometer for use in analyzing gas components (partial pressure measurement) in a test piece such, as a vacuum chamber and the like.

BACKGROUND ART

In a vacuum processing such as film, forming and the like, e.g., by sputtering or vapor deposition, there are cases where not only the pressure at the time of processing but also the compositions of residual gases in a vacuum chamber which serves as a processing chamber give a large influence on the quality of the film and the like. In order to analyze the compositions of this kind of residual gases (gas components), a quadrupole mass spectrometer has conventionally been used.

The quadrupole mass spectrometer is constituted by a sensor section which is detachably fitted to a test piece, and a control unit. As the sensor section, there has conventionally been used one which, supposing that the direction of fitting the sensor section to the test piece is in an upward direction, is provided with a disk-shaped, supporting body which is provided on a lower end of the sensor section; an ion detection section which is provided on the supporting body and which collects the ions; a quadrupole section which, is provided, on the ion detection section and in which four columnar electrodes are disposed at a circumferentially predetermined distance from one another; and an ion source which is provided on the quadrupole section and which has a filament and a grid to ionize the above-mentioned gas (see, e.g., patent document 1).

In order to apply an ionization voltage between the filament and the grid, and to form electric field in the quadrupole section, and to perform the like operations, the filament and the grid of the ion source, the quadrupole section, and the like are ordinarily connected by wiring to the connection terminals that are provided in the supporting body, and it is thus so arranged that electric power is supplied from the control unit through these connection terminals. As the wiring between the filament, the grid, the quadrupole section, and the connection terminals, there are used metallic wires such as copper and the like coated with covers made of ceramics in order to secure electric insulation. Therefore, in case the ion detection section, the quadrupole section, and the ion source are arranged from the side of the supporting body in the order as mentioned, as in the above-mentioned conventional example, a plurality of long wires are required, thereby resulting in a higher manufacturing cost, in addition, there is a disadvantage m that the assembling of the sensor section becomes troublesome, By the way, as the above-mentioned filament, in place of a filament of tungsten make, there is recently used one which is manufactured by coating the surface of an Ir wire with an yttrium oxide, whereby the lifetime of the filament has largely been extended. As a result of prolonged lifetime of filament, it has become evident that the grid is contaminated by the adhesion of molecules and atoms in the vacuum atmosphere and that, due to this contamination, the sensitivity of measurement lowers.

As a method of cleaning the contaminated grid, there are known: electron collision system in which a voltage (about 300 V) is applied between the filament and the grid to cause the electrons to collide against the surface of the grid to thereby remove the molecules and atoms adhered, to the surface of the grid; and a so-called resistance heating system in which a current is caused to flow through the grid to thereby remove, by means of Joule heat, the molecules and atoms adhered to the surface of the grid (see, e.g., patent document 2).

When the resistance heating system is employed, it is necessary to form a closed circuit between the grid and the positive and the negative outputs from the DC power for resistance heating. In this case, connection will have to be made by separate further wiring to the connection terminals provided in the supporting body whereby the wiring to the grid becomes longer in the above-mentioned conventional example. Therefore, power loss becomes too large to be suitable for resistance heating. In addition, the quadrupole mass spectrometer becomes further complicated in construction and the assembling thereof becomes further difficult. As a result, the resistance heating system has conventionally rarely been employed.

On the other hand, when the electron collision system is employed, there are problems in that, during the time in which the electrons arc caused to be collided against the surface of the grid, mass analysis (measurement) by the mass analyzer cannot be made, and further that there is a possibility of giving rise to electric discharge if the pressure is high at the time of colliding the electrons at a high voltage.

PRIOR ART DOCUMENTS

[Patent Documents]

Patent Document 1: JP-A-2004-349102

Patent Document 2: JP-A-2000-39375

SUMMARY OF THE INVENTION

[Problems to be Solved by the Invention]

In view of the above points, this invention has a problem to provide a lowcost quadrupole mass spectrometer which can materialize the resistance heating of the grid, and which is capable of analyzing the gas components at a high accuracy while preventing the sensitivity from lowering.

[Means for Solving the Problems]

In order to solve the above problem, there is provided a quadrupole mass spectrometer capable of analyzing gas components in a test piece, the quadrupole mass spectrometer comprising a sensor section adapted to be detachably fitted to the test piece. Supposing that a direction of fitting the sensor section to the test piece is in an upward direction, the sensor section comprises: a predetermined shape of supporting body provided at a lower end of the sensor section; an ion source provided on the supporting body and having a filament and a grid for ionizing the gas; a quadrupole section provided on the ion source and having four columnar electrodes disposed at a predetermined circumferential distance from one another; and an ion detection section, provided on the quadrupole section in order to collect predetermined ions that pass through the quadrupole section by applying DC and AC voltages between opposite electrodes.

According to a first embodiment of this invention, since the ion source is positioned on the side of the supporting body the expensive wiring for the ion source can be made shorter in length. In this case, the wiring to the ion detection section conversely becomes longer in length than that of the conventional example, but the wiring for the ion current detection may be only one in number. Therefore, as compared with the above-mentioned conventional example, not only can the construction be simplified and its assembling be made easier but also can the cost be lowered.

By the way, if the ion detection section is present, as in the above-mentioned first embodiment, in a position that is farthest from the supporting body i.e., in a position which is in contact with the atmosphere in the test piece that is going to be subjected to gas analyzing, there is a possibility that the ions of the gas components that are present in the test piece may also be detected by the ion detection section. Depending on the test piece, there is thus a possibility that high-accuracy analyzing cannot be performed. Therefore, the ion detection, section shall preferably employ an arrangement in which a shielding means is further provided thereabove for shielding the ion detection section.

Further, in the first embodiment of this invention, there may be employed an arrangement in which the supporting body comprises: a cylindrical wall elongated upward beyond the ion source in a manner to enclose the ion source; and a flange which is provided on an upper end of the cylindrical wall and winch can be fixed to the test piece.

Further, in order to solve the above-mentioned problem, according to a second embodiment of this invention, there is provided a quadrupole mass spectrometer capable of analysing gas components in a test piece, the quadrupole mass spectrometer comprising a sensor section adapted to be detachably fitted to the test piece. Supposing that a direction of fitting the sensor section to the test piece is in an upward direction, the sensor section comprises: a predetermined shape of supporting body provided on a lower end of the sensor section; an ion source arranged on the supporting body and having a filament and a grid for ionizing the gas; a quadrupole section arranged on the supporting body near the ion source and having four columnar electrodes which are disposed in parallel with a direction at right angles to the upward and downward direction and which are disposed at a predetermined circumferential distance from one another; and an ion detection section arranged on the supporting body near the quadrupole section in order to collect predetermined ions that pass through the quadrupole section by applying DC and AC voltages between the opposite electrodes.

According to the second embodiment of this invention, since the ion source, the quadrupole section, and the ion defection section are provided on the supporting body in parallel with one another, like in the above-mentioned first embodiment, the expensive wiring to the ion source can be made shorter in length and, further, the wiring to the ion detection section can be made the same in length as in the above-mentioned conventional example. Therefore, as compared with the above-mentioned conventional example, not only can the construction be simplified and it assembling be made easier but also can a further cost reduction be attained.

Here, at the time of fitting the above-mentioned sensor section, to the test piece, there are cases where the sensor section is contained into the tubular body (the cylindrical wall) and is fitted, as they are, to the test piece. In such a case, by employing the arrangement according to the above-mentioned second embodiment, the tubular body can be made shorter in length than the one in the first embodiment and, consequently, the amount of projection of the tubular body beyond the test piece when fitted to the test piece can advantageously be made smaller.

In the above-mentioned first and the second embodiments, preferably free ends of the filament and the grid of the ion source are connected, without wiring, to connection terminals that are fixed by penetrating the supporting body in the upward and downward direction. According to this arrangement, since both the free ends of the filament and the grid are made to be so-called direct connection to the connection terminals of the supporting body expensive wiring for the ion source can be made needless. In addition, by eliminating the wiring loss, there can be materialized an arrangement in which the resistance heating of the grid can be efficiently attained. In conclusion, the wiring for the ion source can be made needless. As a consequence, due to combined facts that the wiring for the ion source can be made needless so as to make the effect of degassing from the wiring smaller, and that the grid can be efficiently prevented from getting contaminated by resistance heating, it becomes possible to perform analysis of gas components (partial pressure measurement) at a high sensitivity and accuracy.

Further, in order to facilitate the fitting in position and handling of the sensor section, it is advantageous to arrange that each of the electrodes of the quadrupole section is held by an electrically insulating holder and that the holder is detachably fitted to the supporting body In this case, it is advantageous to arrange that the ion detection section is detachably fitted to the holder or to the supporting body.

The quadrupole mass spectrometer preferably further comprises a plate-like ion collector which is disposed on the supporting body in a manner to lie opposite to the ion detection section with the grid of the ion source being sandwiched, therebetween so as to enable measurement of a total pressure in the test piece.

On the other hand, the quadrupole mass spectrometer preferably further comprises a cylindrical ion collector disposed on the supporting body in a manner to enclose the ion source having the filament and the grid to enable measurement of a total pressure in the test piece.

According to the above arrangement, it is possible to measure with a single quadrupole mass spectrometer the total pressure of the test piece in addition to the analysis of the gas components. Further, by arranging that the ion collector is directly connected to the connecting terminals that are provided in the supporting body, the expensive wiring for detecting the ion current becomes needless, whereby a lowcost arrangement for measuring the total pressure can be materialized. In addition, by employing the arrangement according to the above-mentioned first embodiment to thereby employ the arrangement in which the quadrupole section and the ion detection section are detachably fitted to the supporting body only by detaching these parts, they can be constituted into a vacuum gauge for measuring the total pressure of the test piece. Depending on the uses, it can be separately used as a vacuum gauge or as a quadrupole mass spectrometer provided with a vacuum gauge.

By the way in case the ion collector is formed into a plate shape, the surface thereof is likely to be contaminated and is subject to lowering of the sensitivity. Alternatively In ease the ion collector is formed into a cylindrical form, there is also a possibility that the total pressure cannot be measured at a high accuracy down to a lower pressure under the influence of soft X rays and the like. Therefore, the kind of the ion collector will have to be appropriately selected depending on the uses.

In addition, the quadrupole mass spectrometer according to this invention shall preferably employ an arrangement further comprising a vacuum gauge capable of measuring a pressure within a pressure range from atmospheric pressure to a pressure at which thermionic electrons can be emitted by the filament. According to this arrangement, in order to measure the pressure in the test piece after the test piece has been evacuated to the time of starting the gas analysis, there will be required no measuring means such as a Pirani gauge and the like, it is therefore advantageous to fit the quadrupole mass spectrometer according to this invention to a test piece having no vacuum gauge, thereby performing an analysis.

EMBODIMENTS FOR CARRYING OUT THE INVENTION

With reference to the drawings, a detailed description will hereinafter be made of a quadrupole mass spectrometer according to the first embodiment of this invention with an example of a case in which a test piece TP is a vacuum chamber, and in which the quadrupole mass spectrometer is fitted to a test port TP1 of this test piece TP to thereby analyze the gas components in the test piece TP.

Figure 1:
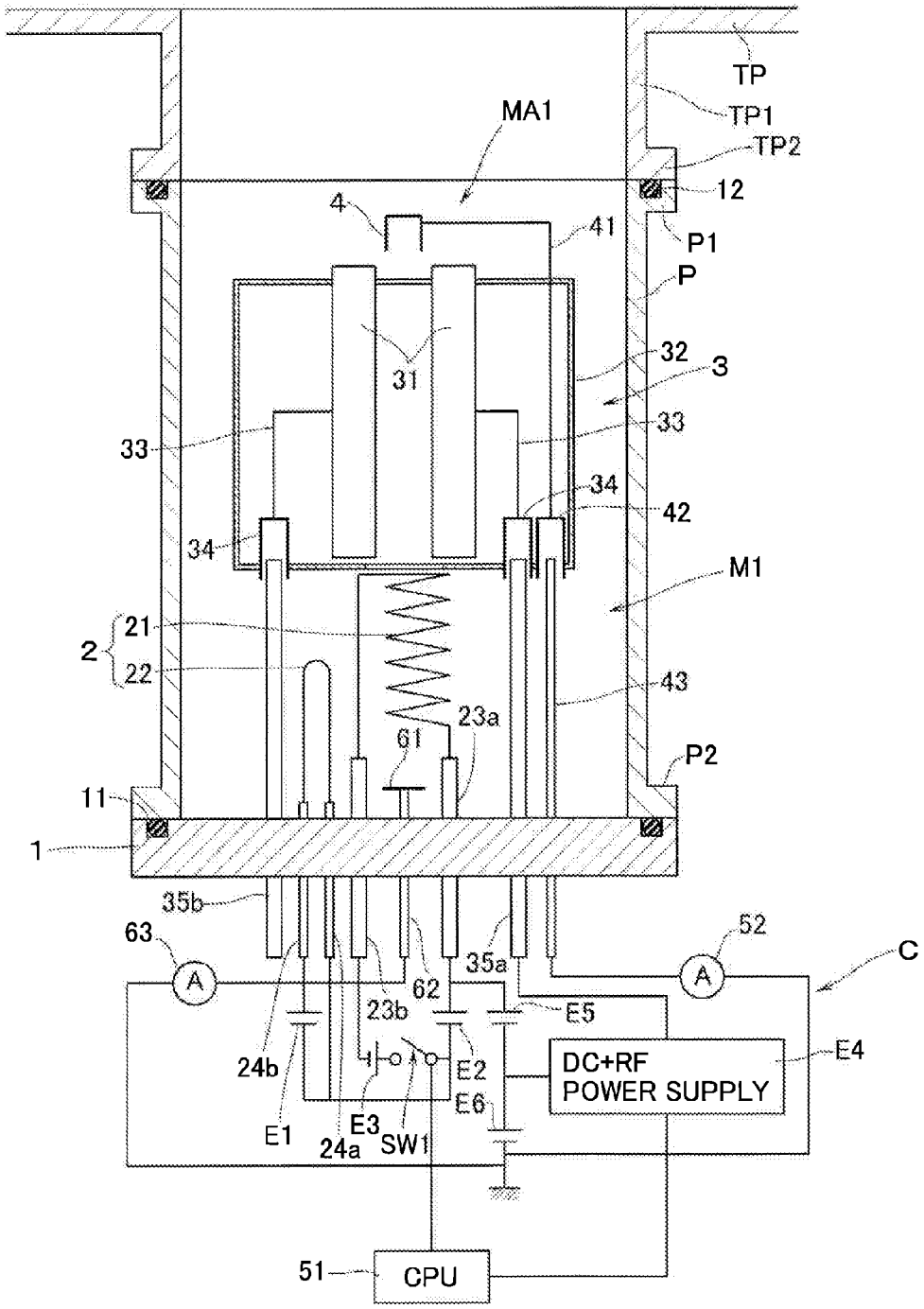
FIG. 1 is a drawing showing an arrangement of a quadrupole mass spectrometer according to a first embodiment of this invention.

With reference to FIG. 1, reference numeral MA1 denotes a quadrupole mass spectrometer, and this quadrupole mass spectrometer MA1 is constituted by a sensor section M1 and a control unit C. The sensor section M1 has a disk-shaped supporting body 1. The supporting body 1 is made of a metal such as aluminum, stainless steel, and the like and is provided with an O-ring (sealing means) 11 along the upper outer peripheral portion thereof. Hereinafter, a description is made on condition that the direction of fitting the sensor section M1 relative to (onto) the test piece TP is an upper direction.

An ion source 2 is provided, on the supporting body 1. The ion source 2 is constituted by: a helical grid 21 which is disposed on an upper part in the central portion of the supporting body 1; and a filament 22 which is disposed around the grid 21 and which is made by coating the surface of an Ir wire with yttrium oxide. Free ends of both the grid 21 and the filament 22 are respectively connected (directly connected) to connecting terminals 23*a*, 23*b* for the grid and to connecting terminals 24*a*, 24*b* for the filament, all the connecting terminals being vertically provided by penetrating the supporting body 1 in the upward and downward direction.

On top of the ion source 2 there is provided a quadrupole section 3 in which four columnar electrodes 31 are disposed at a predetermined distance from one another in the circumferential direction and in which the opposite electrodes 31 are electrically connected to each other. Each of the electrodes 31 is supported by a cylindrical holder 32 which is made of an electrically insulating material, and the supporting is made in such a manner that an upper portion of each of the electrodes 31 projects upward through the holder 32. On the lower surface of the holder 32 there are provided two socket-type connectors 34 which are respectively connected to the electrodes 31 through wiring 33. By mounting through fitting the socket-type connectors 34 in the bolder 32 from an upper side onto the two connecting terminals 35*a*, 35*b* which are vertically provided in the supporting body 1, the holder 32 is detachably supported at the connecting terminals 35*a*, 35*b* by the supporting body 1, and electrical connection is made accordingly. The construction of the sensor section M1 can thus be simplified. By the way, the method of supporting the bolder 32 by the supporting body 1 is not limited to the above, but may be so arranged as to provide the supporting body 1 with a separate supporting member (not illustrated), so that the bolder 32 can be supported by the separate supporting member.

On an upper portion of the inner side of each of the electrodes 31 of the quadrupole section 3, there is provided an ion detection section 4. The ion detection section 4 is constituted by a Faraday cup which collects the gas molecules which are ionized by the ion source 2 and pass through the clearance among respective electrodes 31 of the quadrupole section 3 to thereby reach the upper portion of the quadrupole section. The wiring 41 from the ion detection section 4 is also connected to the socket-type connectors 42 which are provided on the lower surface of the holder 32. In the same manner as above, the wiring 41 is so arranged as to be connected to the connection terminals 43 that are vertically provided in the supporting body 1. As the wiring 33, 41 there is used one which is made by coating, with ceramic cover, a metallic wire of copper and the like.

On the other hand, the control unit C is provided with a control section 51 winch is equipped with a computer, a memory, a sequencer, and the like. The control section 51 performs an overall control over the operation of each of the power sources (to be described hereinafter), switching of switching elements in power supply circuits, outputting to a display device (not illustrated) of measured current values, and the like operations. Further, the control unit C is provided with a power supply E1 for the filament, and an ionizing power supply E2 for ionizing the gases inside the test piece TP. One (positive) of the outputs from the power supply E1 is connected to the connecting terminal 24*b* for the filament, and one (positive) of the outputs from the power supply E2 is connected to one of the connecting terminal 23*a* for the grid. The other outputs (negative) from both the power supplies E1, E2 are connected to each other, and to this negative output is connected the wiring from the other connecting terminal 24*a* for the filament. In addition, the control unit C is provided with a power supply E3 and a switching element SW1 for resistance heating of the grid 21. One (negative) output from the power supply E3 is connected to the connecting terminal 23*b*, and the other (positive) output is connected to the other output from the power supply E2 through the switching element SW1.

Further, the control unit C is provided with a DC+RF power supply E4 for respectively applying DC and RF voltages to electrically coupled electrodes 31. Output of the DC+RF power supply E4 is respectively connected to either one of the opposite electrodes 31 (in FIG. 1, only one is illustrated). In addition, the control unit C is provided, in series, with a power supply E5 for ion acceleration and a power supply E6 for forming central electric field. One of the outputs from the power supply E5 is connected to one (positive) of the outputs from the power supply E2, and the other of the outputs is grounded. Further, the control unit C is additionally provided with, an ammeter 52 for measuring the value of the ion current that is collected by the ion detection section 4 and flows to the ground.

The quadrupole mass spectrometer MA1 of the above-mentioned first embodiment is arranged to be able to measure also the total pressure inside the test piece. In other words, on the supporting body 1 there is provided a plate-like ion collector 61 in a manner to lie opposite to the ion detection section 4 with the grid 21 being sandwiched therebetween. The ion collector 61 is directly connected to a connecting terminal 62 that is provided on the supporting body 1 by penetrating the supporting body 1 in the vertical, (upward and downward) direction. Further, the control unit C is additionally provided with an ammeter 68 for measuring the value of the ion current that is collected by the ion collector 61 and then flows to the ground.

Now, a description will be made of an example of using the above-mentioned quadrupole mass spectrometer MA1. In putting the quadrupole mass spectrometer MA1 to actual use, a tubular body P having a flange P1, P2 on each end thereof is mounted around, the sensor section M1. In other words, the tubular body P is inserted onto an outside, and from an upper side downward, of the sensor section M1. The flange P2 on the lower side of the tubular body P is thus brought into surface contact with an external upper edge portion of the supporting body 1, and is fixed in this state by means of clamps and the like. As a result, vacuum sealing by means of the O-ring 11 is attained. In this state the flange P1 on the upper side of the tabular body P is brought into surface contact, through an O-ring 12, with the flange TP2 of the test port TP1 in the test piece TP and is fixed in this state by means of clamps and the like, whereby the mounting of the sensor section M1 is finished. Alternatively the sensor section M1 can also be directly mounted onto the test port P1 without using the tubular body P. Then the test piece TP is evacuated by a vacuum pump and, when a predetermined, vacuum pressure has been reached, gas analysis is started.

First, DC current is caused to flow by the power supply E1 to the filament 22 so as to heat the filament 22 red hot, thereby causing thermions to be emitted. Then by applying a positive voltage to the grid 21 by means of power supply E2, the emitted, thermions are attracted. At this time positive ions are generated from those gas atoms and molecules around the filament 22 that are collided, with the thermions. Then, by applying a predetermined voltage from the power supply E5 between the grid 21 and the electrode 31, the ions of the ionized gas components are attracted from the side of the grid 21 toward the quadrupole section 3. In the above-mentioned state, the switching element SW1 is maintained in the OFF (cut-off) state. Further, the value of the ion current that flows through, the ion collector 61 is measured by the ammeter 63, and the total pressure at that time can also be measured.

The four electrodes 31 of the quadrupole section 3 receive from the DC+RF power supply E4 an application of a predetermined AC voltage superposed with a DC voltage levitated from the ground potential by the central electric field voltage due to the power supply E6. According to this arrangement, when the ion groups pass through the quadrupole section 3, they travel while vibrating and, depending on the AC voltage and frequency only certain ions pass while stably vibrating, thereby reaching the ion detection section 4. Then, the ion current is measured by the ammeter 52 that is additionally provided in the ion detection section 4. and the value of the ion current at that time is outputted to the control section 51. Further, by linearly varying the AC voltage while maintaining the ratio between the above-mentioned DC voltage and the AC voltage, the spectra can be obtained and the gas components inside the test piece can be analyzed from the value of the ion current. In this ease, it is also possible to display an indicated value as calculated from the value of the ion current relating to a specified gas component.

Then, for example, if the sensitivity lowers so that the indicated value at the specified gas component varies (lowers) beyond a predetermined range, a judgment is made by the control section 51 that the grid 21 has been contaminated. Once the judgment is made that the grid 21 has been contaminated, the switching element SW1 is switched on (connected) by the control section 51. Electric current of about 2 A is supplied by the power supply E3 to the grid 21 to perform resistance heating only for a predetermined period of tune. According to these operations, the molecules and atoms adhered to the surface of the grid 21 are removed by evaporation.

As has been described hereinabove, according to the quadrupole mass spectrometer MA1 of the first embodiment, by positioning the ion source 2 on the side of the supporting body 1, and by connecting both of the free ends of the filament 22 and the grid 21 directly to the connecting terminals 23*a*, 23*b*, 24*a*, 24*b* that are vertically provided on the supporting body 1, expensive wiring can be made needless. In this case, while the wiring to the ion detection section 4 becomes longer in length than that of the conventional one, only one will be sufficient as the wiring for detecting the ion current. Therefore, as compared with the above-mentioned conventional example, the quadrupole mass spectrometer of this invention can not only be made simpler in construction with consequent ease of assembling, but also can the cost be made lower. In addition, as a result of eliminating the wiring loss, the construction of efficiently performing resistance heating of the grid 21 can be materialized. In conclusion, as a result of combined effect of freedom from the effect of degassing from the wiring due to the elimination of wiring for the ion source 2; and of efficient prevention of contamination of the grid by resistance beating, it becomes possible to analyze the residual gas components at a high, sensitivity and accuracy In addition, according to the above-mentioned first embodiment, as a result of employing the construction in which each of the electrodes 31 of the quadrupole section 3 is held by the holder 32; the ion detection section 4 is detachably fitted to the holder 32; and the holder 32 is provided with socket-type connectors 34, 42 so as to fit them into the connecting terminals 35*a*, 35*b*, 43 that are vertically provided on the supporting plate 1, the assembly and handling thereof can advantageously be made far easier. Still furthermore, in addition to the analyzing of the gas components (partial pressure measuring) by means of a single set of quadrupole mass spectrometer MA1, the measurement of the total pressure of the entire test piece can also be made. Further, since the ion collector 61 is directly connected to the connecting terminal 62 that is provided in the supporting plate 1, expensive wiring for ion current detection has been made needless, whereby an arrangement can be materialized for a low-cost total pressure measuring.

A description has so far been made of the quadruple mass spectrometer MA1 according to the above-mentioned first embodiment, but this invention is not be limited to the above. In the above-mentioned embodiment, the sensor section 3 and the control unit C have been made as separate elements. They may however be constituted by integrally assembling into one and the same box body. Further, in the above-mentioned embodiment, the ion detection section 4 is positioned at a position that is farthest from the side of the supporting body 1, i.e., at a position in which the ion detection section comes into contact with the atmosphere inside the test piece, the gas components therein being subjected to analyzing. In such a case, there is a possibility that the ions that are present inside the test piece are also detected by the ion detection, section 4. Depending on the test piece TP, there are thus cases where highly accurate analysis of the gas components cannot be performed.

Figure 2:
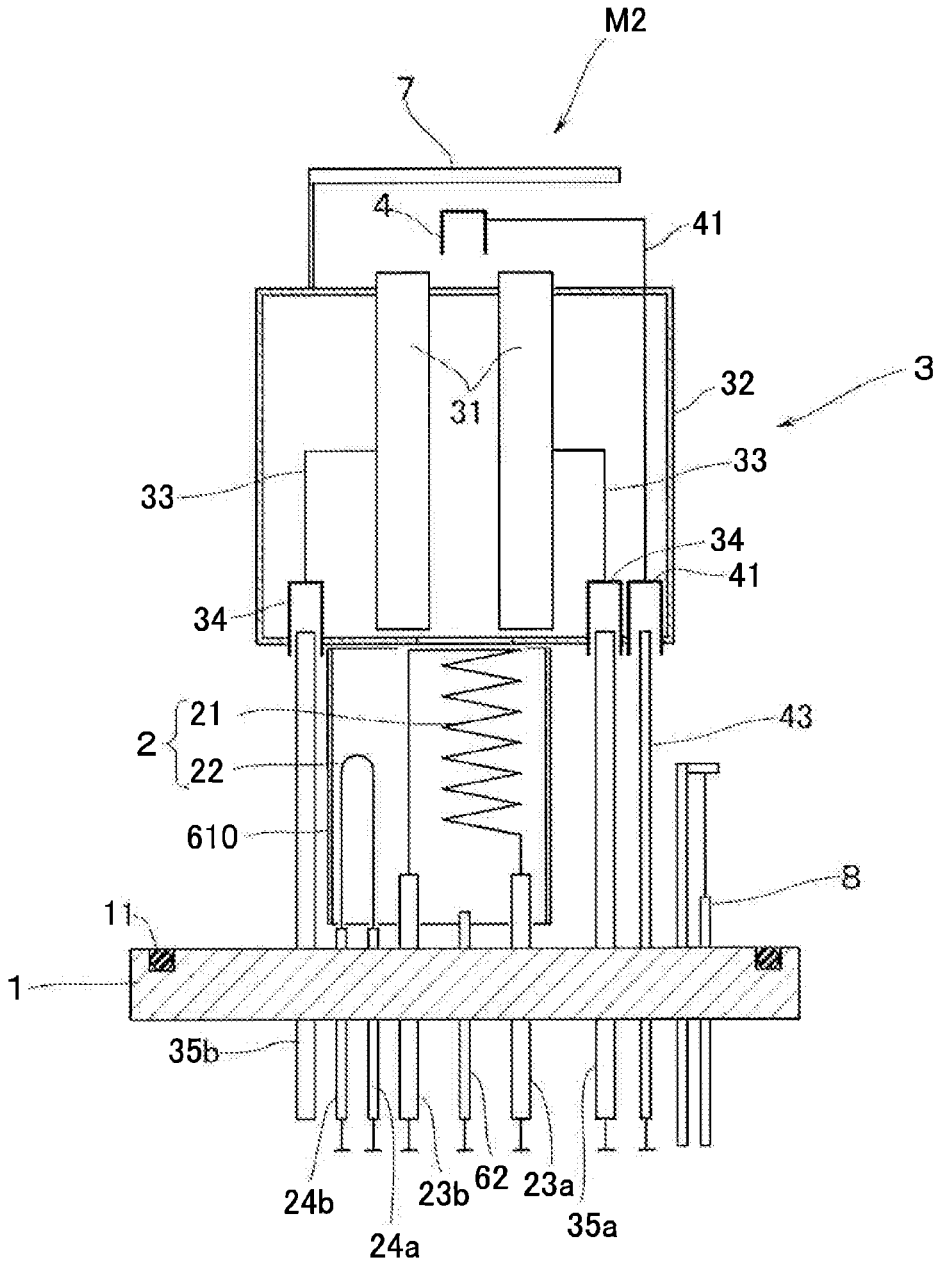
FIG. 2 is a drawing showing an arrangement of another modified example of the quadrupole mass spectrometer shown in FIG. 1.

As a solution, as shown in FIG. 2, the sensor section M2 of the quadrupole mass spectrometer according to a modified example of the first embodiment is further provided with a plate-like shielding member 7 which covers the upper part of the ion detection section 4 in a manner to shield the ion detection section 4 from the ions that may be present inside the test piece. It is to be noted that the shape of the shielding member 7 is not limited to the plate shape but the one in a hemispherical, shape and the like may also be used.

Further, in the above-mentioned first embodiment, a description has been made of one which is provided with a plate-like ion collector 61 so as to be able to measure the total pressure of the test piece. In case the plate-like shape is employed, the surface thereof is likely to be contaminated, with the consequent that the sensitivity is likely to be lowered. As a solution, the sensor section M2 according to the above-mentioned modified example is provided, as shown in FIG. 2, with a cylindrical ion collector 610. In addition thereto, the sensor section M2 is further provided, with a Pirani gauge 8 so that pressure measurement can be made in a pressure range from atmospheric pressure to the pressure at which the thermions can be emitted by the filament 22. According to this arrangement, there is required no other vacuum gauge in order to measure the pressure inside the test piece until the gas analysis is started after the test piece has been evacuated. This arrangement is advantageous when analysis of the gas components is performed by mounting the above-mentioned sensor section M2 on the test piece that has no vacuum gauge. It is to be noted that the circuit to control the operation of the Pirani gauge 8 is housed in the control unit C.

Figure 3:
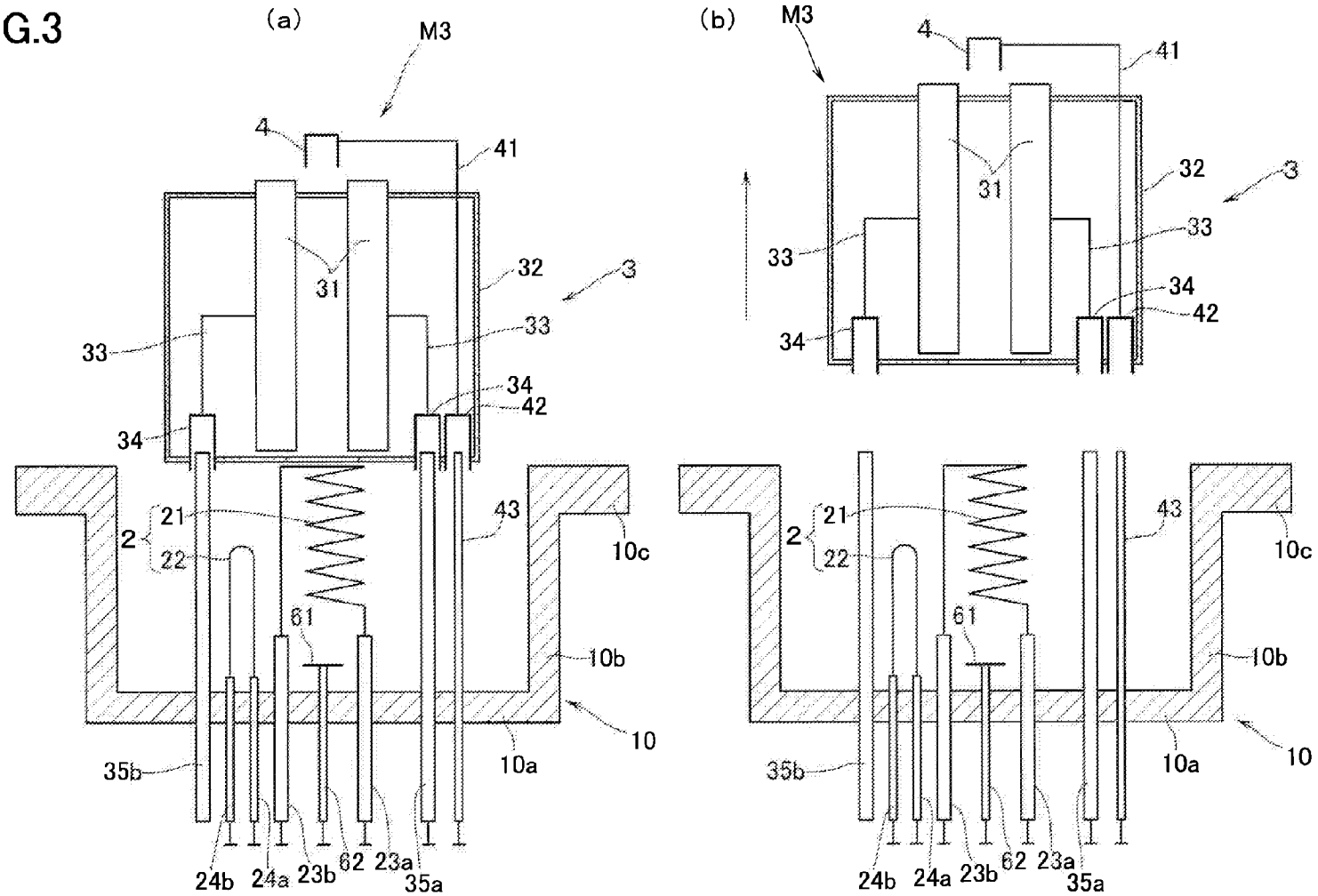
FIG. 3(*a*) is a drawing showing still another modified example of the quadrupole mass spectrometer shown in FIG. 1, and FIG. 3(*b*) is a drawing showing a state in which a quadrupole mass spectrometer relating another modified example is separated.

Further, in the above-mentioned embodiment, a description has been made of an example in which, the supporting body 1 is in circular shape, but it is not limited thereto. In the sensor section M3 relating to another modified example of the first embodiment, the supporting plate 10 is constituted, as shown, in FIGS. 3(*a*) and 3(*b*): by a central base portion 10*a* which is made up of a flat plate; a cylindrical wail portion 10*b* which is vertically provided around the periphery of the base portion 10*a*; and a flange 10*c* which is formed, on an upper end of the cylindrical wall portion 10*b*.

The base portion 10*a* is provided with connecting terminals 23*a*, 23*b* for the grid; and connecting terminals 24*a*, 24*b* for the filament. Further, the upper surface of the flange 10*c* is positioned, at a higher position than the grid 21 which is connected to the connecting terminals 23*a*, 23*b*, and the filament 22 which is connected to the connecting terminals 24*a*, 24*b*. According to this arrangement, once the quadrupole section 3 and the ion detection section 4 are detached, it can. serve as a vacuum gauge (ionization vacuum gauge) for measuring the total pressure in the test piece (see FIG. 3(*b*)).

Figure 4:
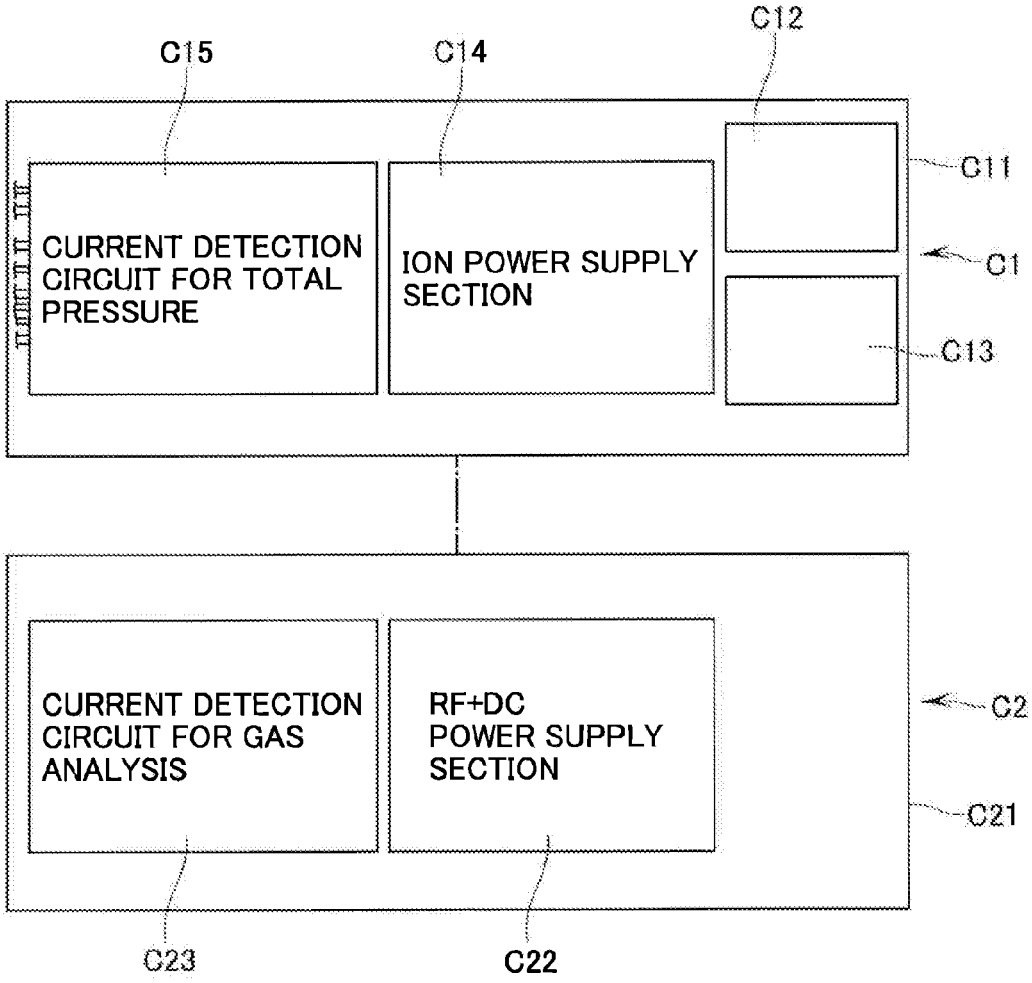
FIG. 4 is a drawing showing an arrangement of a control unit of the quadrupole mass spectrometer.

Further, in the above-mentioned first embodiment, a description, has been made of an example having one control unit C, but this invention is not limited thereto. A description will now be made with reference to FIG. 4 in which the control unit relating to a modified example is constituted by connecting together a main unit C1 for measuring the total pressure and the like inside the test piece, and a sub-unit C2 for analyzing the gas components inside the test piece. In other words, the main unit C1 has a first box member C11. The first box member C11 is provided therein with: a power supply section C12 for supplying electric power; a control section C13, such as CPU and the like, for controlling the operation of the control unit; an ion power supply section C14 for supplying electric power to the ion source 2; and current detection circuit C15 for measuring the current value of the ions collected by ion collectors 61, 610. On the other hand, the sub-unit C2 connected to the main unit C1 in a manner to be freely communicated therewith has a second box member C21. The second box member C21 is provided with: a power supply section C22 which applies DC and HF voltages to the electrodes 31 of the quadrupole section 3; and a current detection circuit C23 which measures the current value of the ions as collected by the ion detection section 4. According to this arrangement, in case the sensor sections M1, M2, M3 of the quadrupole mass spectrometer MA1 are used as vacuum gauges, only those control units which are required, for that purpose may be used.

Figure 5:
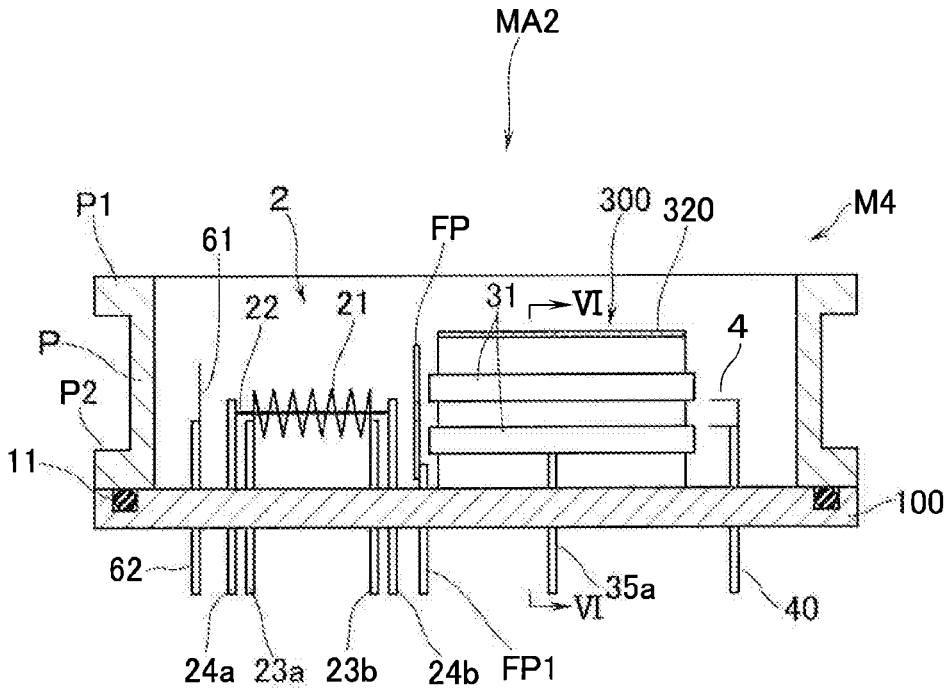
FIG. 5 is a drawing showing an arrangement of the quadrupole mass spectrometer relating to a second embodiment of this invention.

Next, with reference to FIGS. 5 and 6, a description will be made of the constitution of the sensor section M4 of the quadrupole mass spectrometer MA2 according to a second embodiment. Like or the same reference numbers have been attached to like members or elements, and the constitution of the control unit C is supposed to be the same.

The sensor section M4 has a disk-shaped supporting body 100, The supporting body 100 is made of metal such as aluminum, stainless steel, and the like, and is provided on an upper periphery thereof with an O-ring (sealing means) 11. The following description will be made on condition that the direction of fitting the sensor section M4 relative to the test piece TP is in an upward direction. The supporting body 100 is provided, thereon with an ion source 2, The ion source 2 is constituted by: a helical grid 21 which is disposed in parallel with the supporting body 100 on one diametrical side of the supporting body 100; and a filament 22 which is disposed so as to penetrate the center space of the grid 21 and which is coated on the surface of an Ir wire with yttrium oxide. The tree ends of the grid 21 and the filament 22 are respectively connected (directly connected) to those connecting terminals 23*a*, 23*b* for the grid as well as to those connecting terminals 24*a*, 24*b* for the filament which are vertically provided by vertically penetrating the supporting body 100 in the upward and downward direction.

Near the ion source 2 there is disposed an annular focus electrode FP on the diametrically inside of the supporting body 100. The focus electrode FP is directly connected to a connecting terminal FP1 which is vertically provided, by penetrating the supporting body 100 in the upward and downward direction. The connecting terminal FP1 is connected, to a power source which is provided in the control unit C. Then, by applying a predetermined DC voltage to the focus electrode FP at the time of gas analysis, the ions that are incident on the qudrupole section 3 are suppressed from getting dispersed.

Figure 6:
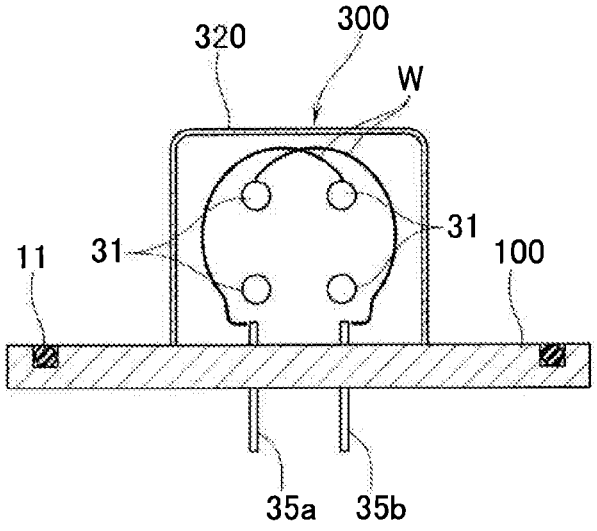
FIG. 6 is a sectional view taken along the line VI-VI in FIG. 5.

On the diametrically inside of the supporting plate 100 near the focus electrode FP there is disposed a quadrupole section 300 in which are provided four columnar electrodes 31 circumferentially at a predetermined distance from one another and in parallel with the supporting body 100, and in which the opposite electrodes 31 are electrically connected together (see FIG. 6). Each of the electrodes 31 is supported by a box-shaped holder 320 which is made of an electrically insulating material and which is open on the bottom side. This holder 320 is detachably fixed to the supporting body 100. Out of the respective opposite electrodes 31, two electrodes are electrically connected by wiring W to the connecting terminals 35*a*, 35*b* which are vertically disposed on the supporting body 100.

On the diametrically opposite side of the supporting body 100 and near the quadrupole section 3, there is provided an ion detection section 4. The ion detection section 4 is constituted by a Faraday cup to collect the gas molecules which travel through the space of each of the electrodes 31 of the quadrupole section 300, thereby reaching the space thereabove. The ion detection section 4 is also connected (directly connected) to the connecting terminal 40 that is vertically provided on the supporting body 100, There is provided a plate-like ion collector 61 in a manner to lie opposite to the ion detection section 4 with the grid 21 being sandwiched therebetween. The ion collector 61 is directly connected to the connecting terminal 62 that is provided by penetrating through the supporting body 1 in an upward and downward direction.

When the quadrupole mass spectrometer MA2 is put to use, there is attached, in the same manner as in the above example, a tubular body P which is provided with flanges P1, P2 on both ends in the periphery of the sensor section M4. According to this arrangement, when the above-mentioned sensor section M4 is fitted to the test piece TP, the tubular body P can be made shorter in length than that of the first embodiment and, as a consequence, the amount of projection beyond the test piece TP when mounted on the test piece TP advantageously becomes smaller. Still furthermore, according to the above-mentioned second embodiment, since the ion source 2, the quadrupole section 300, and the ion detection section. 4 are disposed in parallel with each other on the supporting body 100, wiring can be made needless, and not only can the construction be simplified to thereby facilitate the assembling, but also can further cost reduction be made possible.

DESCRIPTION OF REFERENCE NUMERALS AND CHARACTERS

MA1, MA2 quadrupole mass spectrometer
M1-M4 sensor section
C control unit
1, 10, 100 supporting body
11 sealing means
2 ion source
21 grid
22 filament
3 quadrupole section
31 electrode
32 holder
4 low detection section
35*a*, 35*b*, 43 connecting terminal
61, 610 ion collector (for measuring total pressure)
7 shielding member
8 (Pirani) vacuum gauge

What is claimed is:

1. A quadrupole mass spectrometer capable of analyzing gas components in a test piece, the quadrupole mass spectrometer comprising a sensor section adapted to be detachably fitted to the test piece, wherein, supposing that a direction of fitting the sensor section to the test piece is in an upward direction, the sensor section comprises in the following order:

a predetermined shape of supporting body with connecting terminals that are vertically provided on the supporting body, both the supporting body and the connecting terminals being provided at a lower end of the sensor section;

an ion source provided on the supporting body and having a filament and a grid for ionizing the gas;

a quadrupole section provided on the ion source and having four columnar electrodes disposed at a predetermined circumferential distance from one another; and an ion detection section provided on the quadrupole section in order to collect predetermined ions that pass through the quadrupole section by applying DC and AC voltages between opposite electrodes, wherein both of free ends of the filament and the grid are directly connected to the connecting terminals.

2. The quadrupole mass spectrometer according to claim 1, further comprising, above the ion detection section, a shielding means for shielding the ion detection section.

3. The quadrupole mass spectrometer according to claim 1, wherein the supporting body comprises: a cylindrical wall elongated upward beyond the ion source in a manner to enclose the ion source; and a flange which is provided on an upper end of the cylindrical wall and which can be fixed to the test piece.

4. The quadrupole mass spectrometer according to claim 1, wherein free ends of the filament and the grid of the ion source are connected, without wiring, to connection terminals that are fixed by penetrating the supporting body in the upward and downward direction.

5. The quadrupole mass spectrometer according to claim 1, wherein each of the electrodes is held by an electrically insulating holder, the holder being detachably fitted to the supporting body.

6. The quadrupole mass spectrometer according to claim 5, wherein the ion detection section is detachably fitted to one of the holder and the supporting body.

7. The quadrupole mass spectrometer according to claim 1, further comprising a plate-like ion collector which is disposed on the supporting body in a manner to lie opposite to the ion detection section with the grid of the ion source being sandwiched therebetween so as to enable measurement of a total pressure in the test piece.

8. The quadrupole mass spectrometer according to claim 1, further comprising a cylindrical ion collector disposed on the supporting body in a manner to enclose the ion source having the filament and the grid to enable measurement of a total pressure in the test piece.

9. The quadrupole mass spectrometer according to claim 1, further comprising a vacuum gauge capable of measuring a pressure within a pressure range from atmospheric pressure to a pressure at which thermionic electrons can be emitted by the filament.

10. A quadrupole mass spectrometer capable of analyzing gas components in a test piece, the quadrupole mass spectrometer comprising a sensor section adapted to be detachably fitted to the test piece, wherein, supposing that a direction of fitting the sensor section to the test piece is in an upward direction, the sensor section comprises:

a predetermined shape of supporting body with connecting terminals that are vertically provided on the supporting body, both the supporting body and the connecting terminals being provided on a lower end of the sensor section;

an ion source arranged on the supporting body and having a filament and a grid for ionizing the gas;

a quadrupole section arranged on the supporting body near the ion source and having four columnar electrodes which are disposed in parallel with a direction at right angles to the upward and downward direction and which are disposed at a predetermined circumferential distance from one another; and an ion detection section arranged on the supporting body near the quadrupole section in order to collect predetermined ions that pass through the quadrupole section by applying DC and AC voltages between the opposite electrodes, wherein the ion source, the quadrupole section and the ion detection section are provided on the supporting body in parallel, and wherein both of free ends of the filament and the grid are directly connected to connecting terminals.

11. The quadrupole mass spectrometer according to claim 10, wherein free ends of the filament and the grid of the ion source are connected, without wiring, to connection terminals that are fixed by penetrating the supporting body in the upward and downward direction.

12. The quadrupole mass spectrometer according claim 10, wherein each of the electrodes is held by an electrically insulating holder, the holder being detachably fitted to the supporting body.

13. The quadrupole mass spectrometer according to claim 10, further comprising a plate-like ion collector which is disposed on the supporting body in a manner to lie opposite to the ion detection section with the grid of the ion source being sandwiched therebetween so as to enable measurement of a total pressure in the test piece.

14. The quadrupole mass spectrometer according to claim 10, further comprising a cylindrical ion collector disposed on the supporting body in a manner to enclose the ion source having the filament and the grid to enable measurement of a total pressure in the test piece.

15. The quadrupole mass spectrometer according to claim 10, further comprising a vacuum gauge capable of measuring a pressure within a pressure range from atmospheric pressure to a pressure at which thermionic electrons can be emitted by the filament.

* * * * *